US007392671B1

(12) United States Patent
Dooley et al.

(10) Patent No.: US 7,392,671 B1
(45) Date of Patent: Jul. 1, 2008

(54) ISOLATOR BRAKE HUB ASSEMBLY

(75) Inventors: Eddie Woodrow Dooley, Clarksville, IN (US); Mahmoud Fariz Ismail, Coral Springs, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/480,586

(22) Filed: Jan. 10, 2000

(51) Int. Cl.
*D06F 13/00* (2006.01)

(52) U.S. Cl. ..... 68/133

(58) Field of Classification Search ..... 403/326–329, 403/220, 221, 223; 464/75, 100, 101, 184; 68/132, 133; 188/218 XL
See application file for complete search history.

(56) References Cited

U.S. PATENT DOCUMENTS 1,861,640 A * 6/1932 McCabe ..... 68/133
2,218,275 A * 10/1940 Woodin ..... 68/133 X
2,258,227 A * 10/1941 Skinner ..... 68/133
2,396,866 A * 3/1946 Lytton ..... 403/329 X
4,226,095 A 10/1980 Loken
4,803,855 A 2/1989 Kennedy
4,890,465 A 1/1990 Burk et al.
4,989,712 A 2/1991 Janiszewski
5,509,284 A 4/1996 Hauser
5,522,242 A 6/1996 Hauser
5,605,212 A 2/1997 Hauser
6,183,230 B1 * 2/2001 Beardmore et al.

FOREIGN PATENT DOCUMENTS

DE 297 08 588 8/1997

* cited by examiner

*Primary Examiner*—Greg Binda
(74) *Attorney, Agent, or Firm*—George L. Rideout, Esq.; Armstrong Teasdale LLP

(57) ABSTRACT

A brake hub assembly for a washing machine transmission includes an input shaft, a brake hub, and a deformable isolator insert positioned between the shaft and the hub. The insert includes a plurality of substantially flat legs extending partially into an opening in the brake hub. The legs are deformed by the input shaft when the shaft is positioned within the brake hub. The legs of the isolator insert separate the hub and the shaft and prevent them from rattling.

14 Claims, 3 Drawing Sheets

ISOLATOR BRAKE HUB ASSEMBLY

BACKGROUND OF THE INVENTION

This invention relates generally to brake hub and transmission assemblies and, more particularly, to a brake hub assembly for a washing machine transmission.

A washing machine transmission typically includes a cylindrical input shaft and a brake hub. The input shaft generally includes a plurality of grooves on its exterior surface, and the brake hub includes a generally circular opening to receive the input shaft. The brake hub further includes a plurality of ribs that extend into the opening. In operation, the ribs of the brake hub selectively engage the grooves of the input shaft to decelerate, or brake, the spinning input shaft during a wash cycle.

When braking the hub input shaft, the brake hub and input shaft may rattle due to gaps, or spaces, between the shaft and hub. If the brake hub and input shaft are fabricated to very tight tolerances to reduce rattle, appreciable time and dexterity is required to properly assemble the input shaft into the brake hub. In addition, such small manufacturing tolerances tend to increase manufacturing costs. Given the large volume of washing machines manufactured, even a small increase in manufacturing time and costs per machine leads to significant costs.

Accordingly, it would be desirable to provide a brake hub assembly for a washing machine that eliminates rattle between the brake hub and the input shaft during braking, yet does not require a tight fit between the hub and the shaft.

BRIEF SUMMARY OF THE INVENTION

In an exemplary embodiment of the invention, a brake hub assembly for a washing machine includes an input shaft, a brake hub, and a deformable insert positioned between the brake hub and the shaft. The insert isolates the hub from the shaft which reduces, if not eliminates, rattle between the hub and the shaft. The insert also forms a tight fit between the hub and the shaft.

The brake hub includes a generally circular interior surface that defines an opening, and a plurality of ribs that extend into the opening. The deformable insert includes a plurality of substantially flat legs connected by a ring. The insert is fabricated from a resilient material and fits within the brake hub opening. The insert legs extend between adjacent ribs of the brake hub. The input shaft includes a generally circular exterior surface and a plurality of grooves.

During assembly, the deformable insert is positioned within the brake hub. The input shaft is then positioned within the insert so that the grooves of the input shaft receive the ribs of the brake hub. The insert legs deform around the input shaft and place a load on both the input shaft and the brake hub. The legs also separate the input shaft from the brake hub. Since the shaft and the hub are separated, no rattling sound occurs during operation of the washing machine.

DETAILED DESCRIPTION OF THE INVENTION

Figure 1:
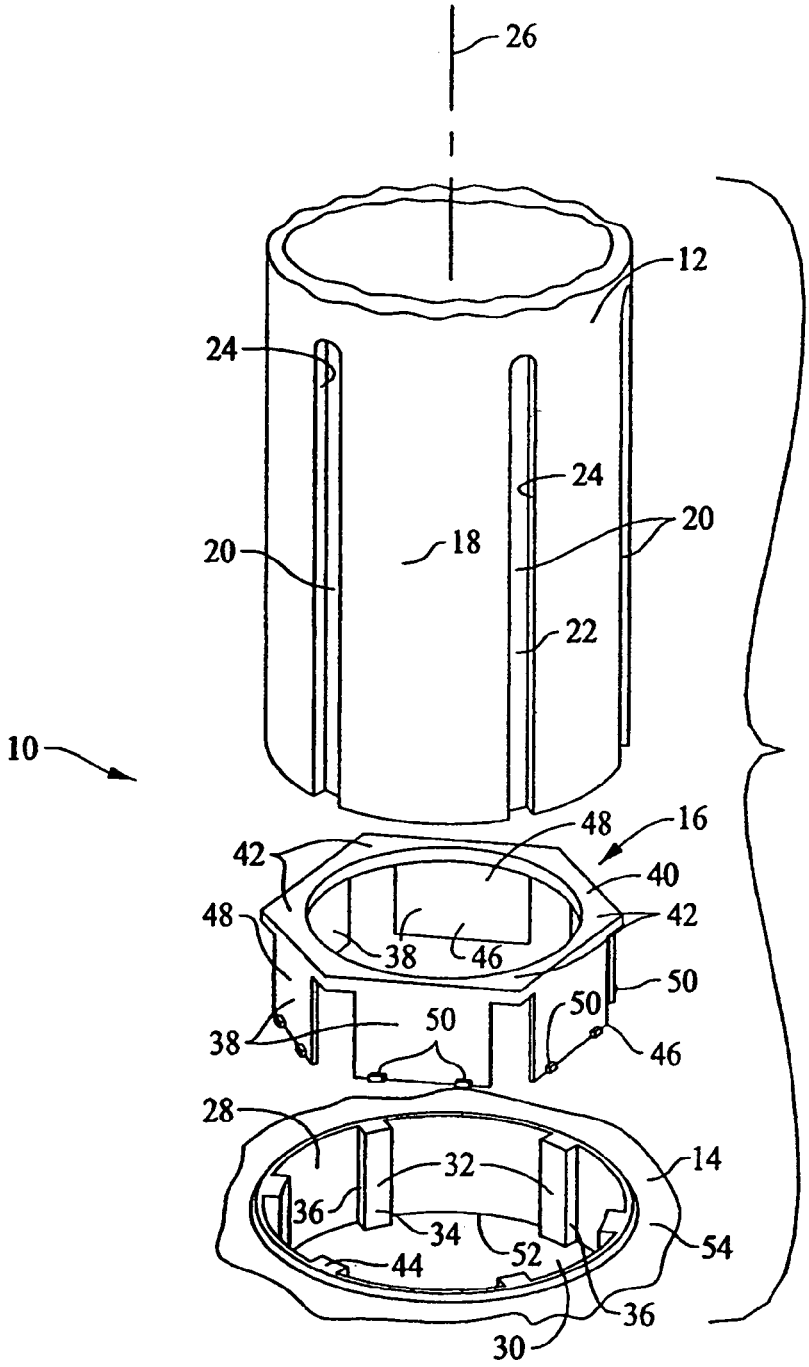
FIG. 1 is a partial exploded view of a brake hub assembly.

FIG. 1 is an exploded view of a brake hub assembly 10 including an input shaft 12, a brake hub 14, and an isolator insert 16. Isolator insert 16 is positioned between brake hub 14 and input shaft 12 and separates brake hub 14 from input shaft 12.

Input shaft 12 includes a generally cylindrical exterior surface 18 and a number of grooves 20. Each groove 20 includes a base 22 and two substantially perpendicular sides 24. Grooves 20 extend inward toward a center 26 of input shaft 12. Input shaft 12 is connected to a motor (not shown) that rotates shaft 12 during operation of a washing machine (not shown).

Brake hub 14 includes a generally cylindrical interior surface 28 that defines a substantially circular opening 30. Opening 30 extends through brake hub 14. Brake hub 14 also includes ribs 32 that project into opening 30. Each rib 32 includes a face 34 and two sides 36 substantially perpendicular to face 34. Brake hub opening 30 is dimensioned to receive input shaft 12 so that each rib 32 extends within a respective groove 20. In an alternative embodiment, greater or fewer than six ribs and grooves as illustrated are used to engage the shaft and the hub. In further alternative embodiments, alternative shapes to the three-sided generally rectangular ribs and grooves are employed.

Isolator insert 16 is fabricated from a resilient plastic and includes a plurality of legs 38 connected to a ring 40. Legs 38 are substantially flat, extend linearly from ring 40, and have a rectangular cross sectional shape. Ring 40 includes a plurality of flares 42 that project from ring 40 between adjacent legs 38. Flares 42 contact a top 44 of ribs 32 when legs 38 are approximately centered between adjacent ribs 32 of brake hub 14 and prevent insert 16 from slipping through brake hub opening 30. In the embodiment illustrated in FIG. 1, isolator insert 16 includes six legs 38 and six flares 42.

Each leg 38 includes a free distal end 46 and a proximal end 48 that is connected to ring 40. A number of tabs 50 project outwardly from distal end 46 of each leg 38. Tabs 50 engage a bottom 52 of brake hub 14 and prevent separation of isolator insert 16 and brake hub 14. Tabs 50 and ring 40 are sufficiently separated so that when isolator insert 16 is fully inserted into brake hub opening 30, tabs 50 contact bottom 52 of brake hub 14 and ring 40 is adjacent a top 54 of brake hub 14. Tabs 50 maintain isolator insert 16 within brake hub 14. While the embodiment shown in FIG. 1 has two tabs 50 on each leg 38, one, three or more tabs 50 could be used on some or all of legs 38.

Figure 2:
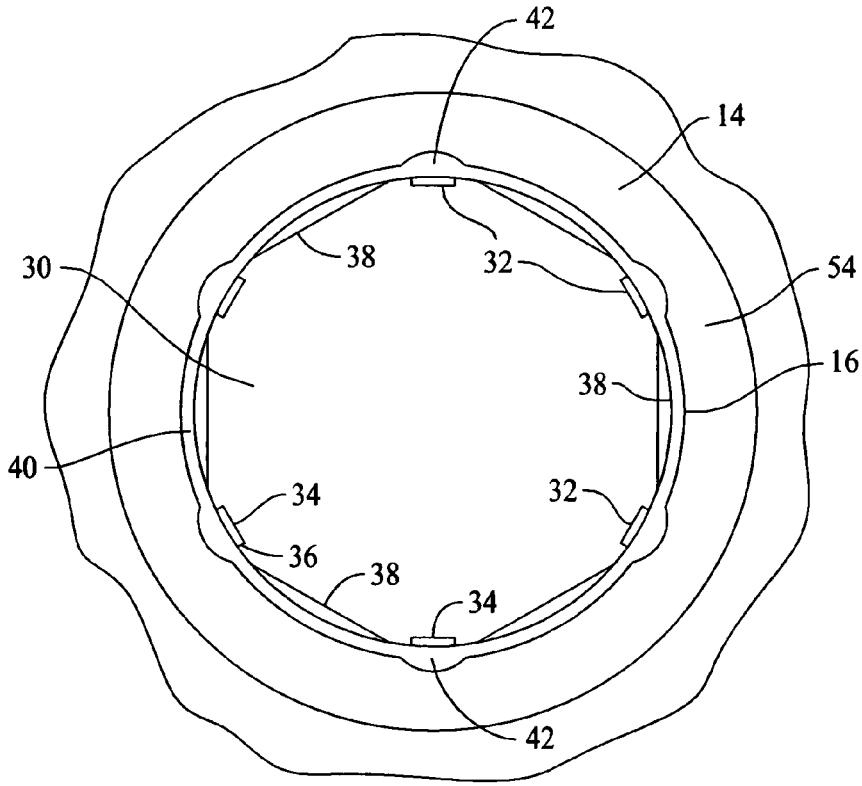
FIG. 2 is a top plan view of the brake hub and isolator shown in FIG. 1 with the isolator inserted into the brake hub.

FIG. 2 is a top view of isolator insert 16 positioned within brake hub 14. Legs 38 extend linearly and approximately equidistant through opening 30 between adjacent ribs 32 of brake hub 14. Brake hub 14 and isolator insert 16 are symmetric to prevent imbalances when attached to a rotating input shaft 12. When isolator insert is inserted into brake hub 14, legs 38 restrict brake hub opening 30 and provide an interference fit with input shaft 12.

Figure 3:
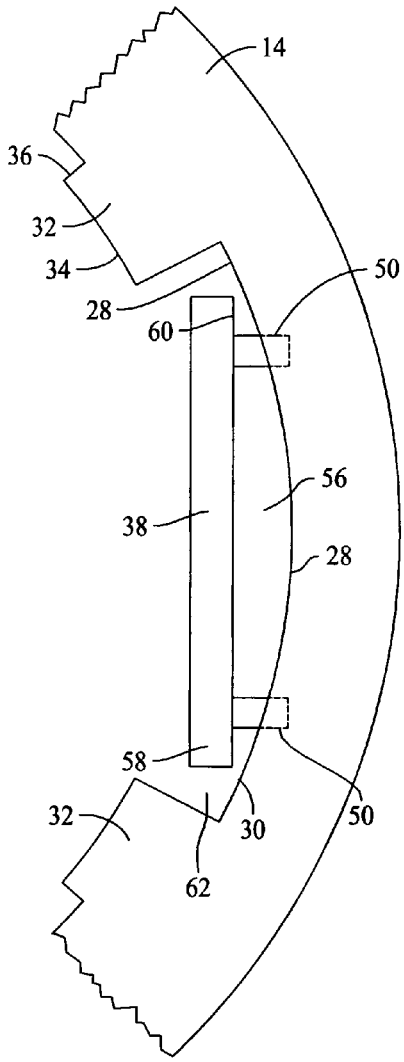
FIG. 3 is a partial cross-sectional view of the brake hub and isolator shown in FIG. 2.

FIG. 3 illustrates a cross section of isolator insert 16 positioned within brake hub 14. Since legs 38 are substantially flat and interior surface 28 of brake hub 14 is substantially round, a gap 56 is created between legs 38 and hub interior surface 28. In addition, each substantially flat leg 38 functions as a beam and provides a load to interior surface 28 of brake hub 14 as a beam, i.e., a load applied to brake hub interior surface 28 by a first side 58 and second side 60 of leg 38. A gap 62 extends between legs 38 and ribs 32. Legs 38 deform within gap 62 without contacting ribs 32 and generating shear stress on ribs 32 when input shaft 12 is positioned within brake hub 14. In an alternative embodiment, legs 38 are substantially flat, include rounded ends, and have an elongate oval cross section.

Figure 4:
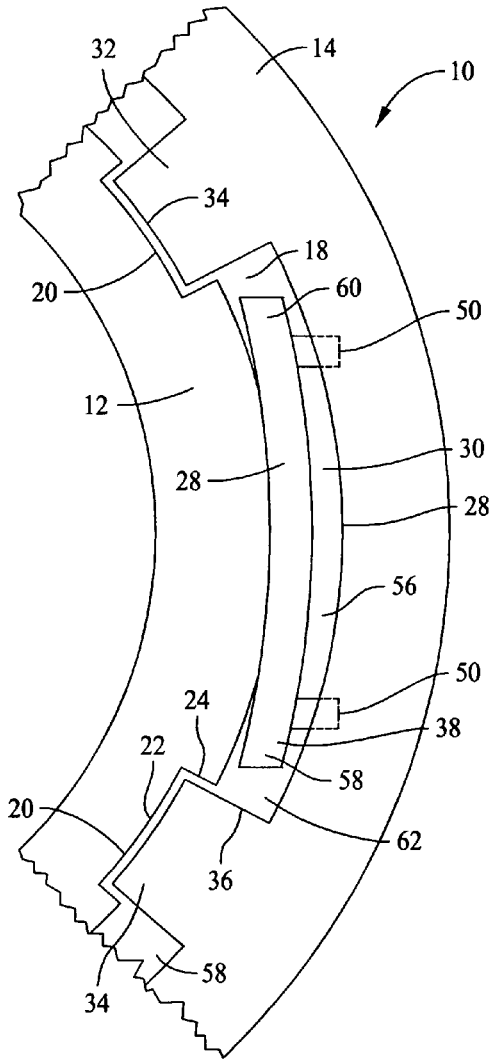
FIG. 4 is a partial cross-sectional view of the brake hub assembly shown in FIG. 1 after the brake hub assembly has been assembled.

FIG. 4 illustrates a cross section of brake hub assembly 10. Input shaft 12 is inserted within isolator insert 16 which is inserted within brake hub 14. Legs 38 are deformed around input shaft 12 and have an arcuate shape approaching the curvature of brake hub opening 30, reducing gap 56 between leg 38 and interior surface 28 of brake hub 14. The resilient deformation of legs 38 directs an inward radial force against input shaft 12, directs an outward radial force against interior surface 28 of brake hub 14, and radially separates brake hub 14 from input shaft 12. Therefore, base 22 of each groove 20 is separated from face 34 of a corresponding rib 32, and rattling between input shaft 12 and brake hub 14 is avoided.

Isolator insert 16 is fabricated of molded plastic or other suitable material sufficiently resilient to separate brake hub 14 from input shaft 12, while still allowing relatively easy positioning of input shaft 12 into isolator insert 16 and brake hub 14. Additionally, the resilient deformation of legs 38 allows a variance in the relative dimensions of brake hub 14 and input shaft 12 while preventing rattling therebetween. Further, due to the load that deflected legs 38 place on shaft 12 and hub 14, close manufacturing tolerances may be relaxed and an acceptable fit may still be achieved between brake hub 14 and input shaft 12.

A method for assembling hub assembly 10 includes inserting isolator insert 16 into brake hub 14 with flat legs 38 extending between adjacent ribs 32 of brake hub 14. Legs 38 are inserted into brake hub opening 30 until tabs 50 at distal ends 46 of legs 38 extend through opening 30 and engage bottom 52 of hub 14. Tabs 50 lock insert 16 to brake hub 14 and prevent isolator insert 16 and brake hub 14 from separating. In addition, flares 42 of insert ring 40 are positioned adjacent rib tops 44. Input shaft 12 is then positioned within opening 30 with grooves 20 engaging ribs 32 of brake hub 14. Input shaft 12 contacts legs 38 of insert 16, causing legs 38 to deform within brake hub 14. Input shaft 12 is thus separated from brake hub 14 and rattling therebetween is prevented.

While the invention has been described in terms of various specific embodiments, those skilled in the art will recognize that the invention can be practiced with modification within the spirit and scope of the claims.

The invention claimed is:

1. A hub assembly for a washing machine transmission, said hub assembly comprising:

a brake hub defining an opening therethrough, a plurality of ribs extending radially inward from an interior surface of said brake hub;

an isolator insert comprising a plurality of legs, said isolator insert positioned at least partially within said brake hub opening, each leg of said plurality of legs configured to extend through said opening and between adjacent ribs of said plurality of ribs with said isolator insert inserted into said brake hub; and an input shaft defining a plurality of grooves within an exterior surface of said input shaft, each groove of said plurality of grooves configured to receive a corresponding rib of said plurality of ribs.

2. A hub assembly in accordance with claim 1 wherein said isolator insert further comprises a ring, said legs connected to said ring.

3. A hub assembly in accordance with claim 1 wherein said legs comprise a substantially rectangular cross section.

4. A hub assembly in accordance with claim 3 wherein said isolator insert comprises six legs.

5. A hub assembly in accordance with claim 1 wherein said hub further comprises a bottom, at least one of said legs comprises a tab, said tab configured to engage said hub bottom.

6. A hub assembly in accordance with claim 1 wherein said brake hub opening is substantially circular.

7. A hub assembly for a washing machine transmission, said hub assembly comprising:

a brake hub defining an opening therethrough, and a plurality of ribs extending radially inward from an interior surface of said brake hub;

an input shaft defining a plurality of grooves within an exterior surface of said input shaft, with said input shaft positioned within said opening, each groove of said plurality of grooves configured to receive a corresponding rib of said plurality of ribs; and an isolator insert comprising a plurality of resilient legs, each leg of said plurality of legs extending at least partially into said brake hub opening between said brake hub and said input shaft and between adjacent ribs of said plurality of ribs.

8. A hub assembly in accordance with claim 7 wherein said legs are substantially flat when said insert is positioned within said hub, and said legs are curved when said isolator insert is positioned onto said input shaft.

9. A hub assembly in accordance with claim 7 wherein said isolator insert comprises six legs.

10. A hub assembly in accordance with claim 7 wherein said insert further comprises a ring connecting said legs.

11. A hub assembly in accordance with claim 7, wherein said legs include a proximal end and a distal end, at least one of said legs including a tab at said distal end, said tab configured to engage said hub.

12. A hub assembly in accordance with claim 7 wherein said legs are separated from said ribs.

13. A hub assembly in accordance with claim 7 wherein said opening is substantially circular.

14. A hub assembly in accordance with claim 7 wherein said insert comprises plastic.

* * * * *